US007056178B1

(12) United States Patent
Chung

(10) Patent No.: US 7,056,178 B1
(45) Date of Patent: Jun. 6, 2006

(54) AMPHIBIOUS TENT

(76) Inventor: Yu-Lin Chung, No 4, Lane 130, Nan-Kang Rd, Sec. 3, Taipei (TW)

( * ) Notice: Subject to any disclaimer, the term of this patent is extended or adjusted under 35 U.S.C. 154(b) by 0 days.

(21) Appl. No.: 11/076,244

(22) Filed: Mar. 8, 2005

(51) Int. Cl.
*B63B 35/58* (2006.01)

(52) U.S. Cl. ..... 441/38; 135/95

(58) Field of Classification Search ..... 441/38, 441/40

See application file for complete search history.

(56) References Cited

U.S. PATENT DOCUMENTS 6,074,260 A * 6/2000 Harris et al. ..... 441/40
6,077,138 A * 6/2000 Schulze ..... 441/40
6,623,322 B1 * 9/2003 Lesniak ..... 441/38
6,634,914 B1 * 10/2003 Vancil ..... 441/40
6,685,520 B1 * 2/2004 Wiggins ..... 441/40

FOREIGN PATENT DOCUMENTS

FR 2591555 A1 * 6/1987

* cited by examiner

*Primary Examiner*—Jesus D. Sotelo
(74) *Attorney, Agent, or Firm*—Pro-Techtor Int'l Services

(57) ABSTRACT

An amphibious tent capable of floating on water surface without capsizing includes three or more floats as a skeleton thereof in addition to the components of a normal tent, power equipment installed to a base of the tent to form a lifeboat, and screens that can be erected to become a sailing boat.

2 Claims, 2 Drawing Sheets

AMPHIBIOUS TENT

BACKGROUND OF THE INVENTION (a) Field of the Invention

The invention relates to a tent capable of floating on water and does not capsize by using the buoyancy of three or more floats.

(b) Description of the Prior Art

Traditional tents for camping are mostly set up on platforms or hillsides, but are not designed to be floating on a water surface. Therefore, those traditional tents can only be called ground-use tents. Although hovercrafts that are used as transportation may be driven on water, they do not serve the purpose of lodging.

SUMMARY OF THE INVENTION

The primary object of the invention is to provide a tent that can float on water by utilizing two inflated bottom plastic floats and one inflated top plastic float; furling screens installed in the top float, and are stretched and hooked to two bottom floats; and supporting frames for joining three floats at each end, thereby forming the structure of the tent.

Another object of the invention is to provide a lifeboat capable of sailing on water, in that the lifeboat comprises bearings respectively connected to the supporting frame at each two corresponding ends of the three floats by connecting rods, a base hanging between two bearings, and a power equipment installed to the base. The top float of the tent may erect screens therein to form a sail for the lifeboat.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
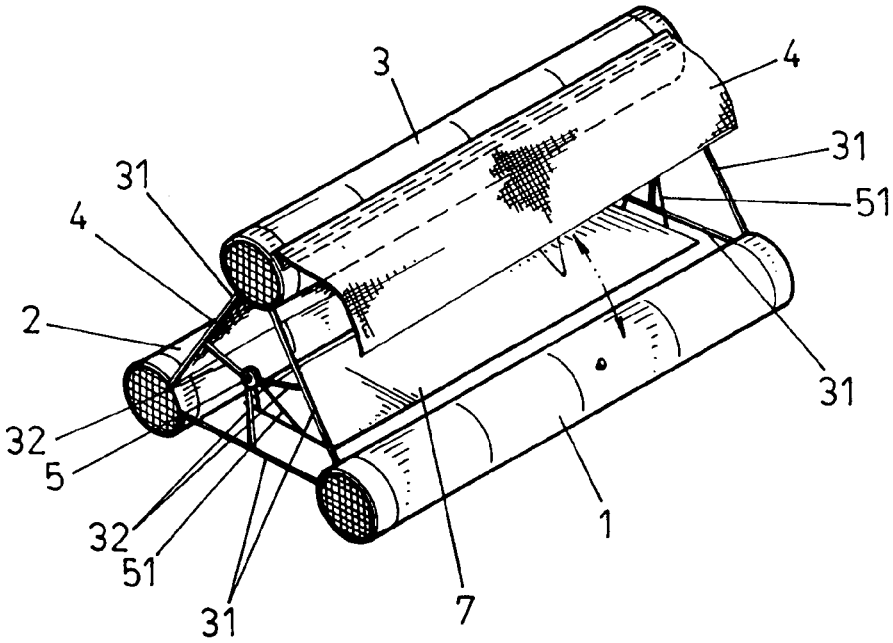
FIG. 1 shows an elevational view according to the invention.
Figure 2:
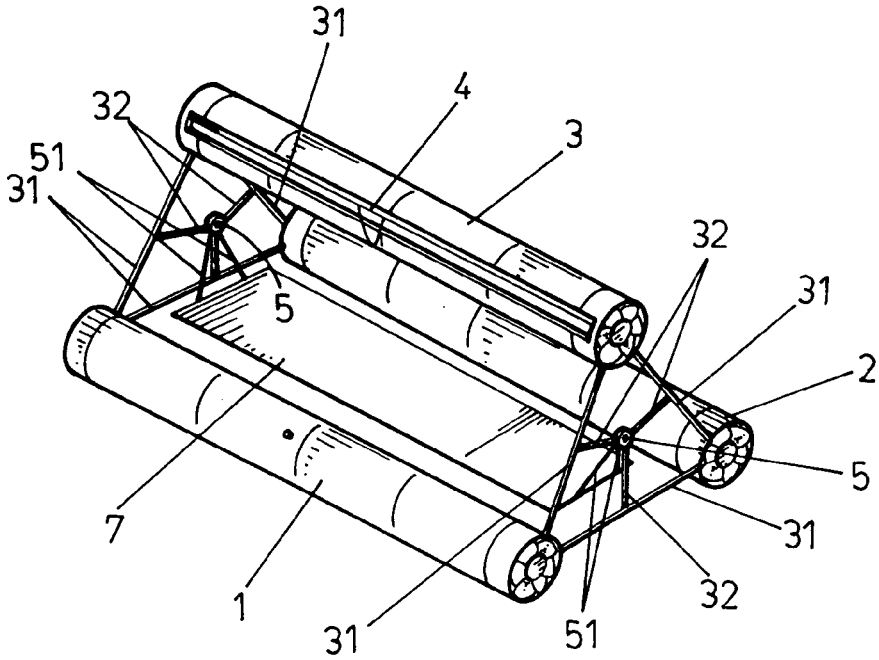
FIG. 2 shows another elevational view according to the invention.

As shown in FIGS. 1 and 2, a tent according to the invention comprises three or more plastic inflated floats.

Two bottom floats 1 and 2 are joined with the top float 3 to form a triangular skeleton of the tent. A supporting frame 31 is used to connect respective set of two floats 1 and 3, 2 and 3, and 1 and 2. The top float 3 contains hidden furled screens 4. When not in use, the furled screens 4 are stored in the upper float 3, and are stretched and hooked to two bottom floats 1 and 2 to form amphibious tent that can float on water.

The supporting frame 31 at left and right sides of three floats 1, 2 and 3 utilizes connecting rods 32 to link a bearing 5, respectively. A base 7 utilizes ropes 51 to hang on two bearings 5. Power equipment can be installed to the base 7 to enable the amphibious tent to sail on water as a lifeboat.

Figure 3:
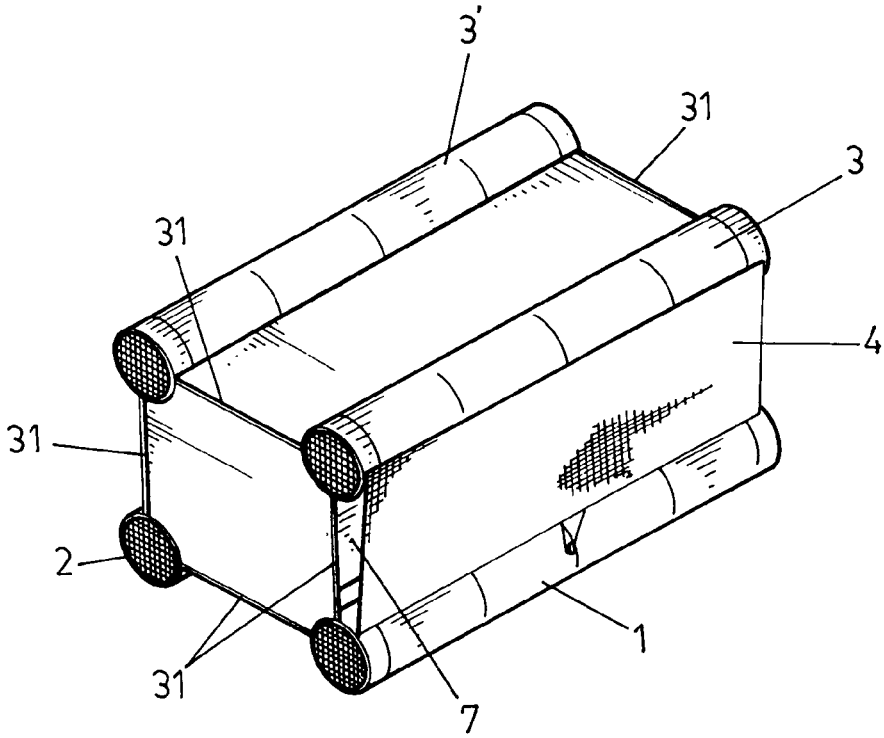
FIG. 3 shows a view of an embodiment according to the invention.
Figure 4:
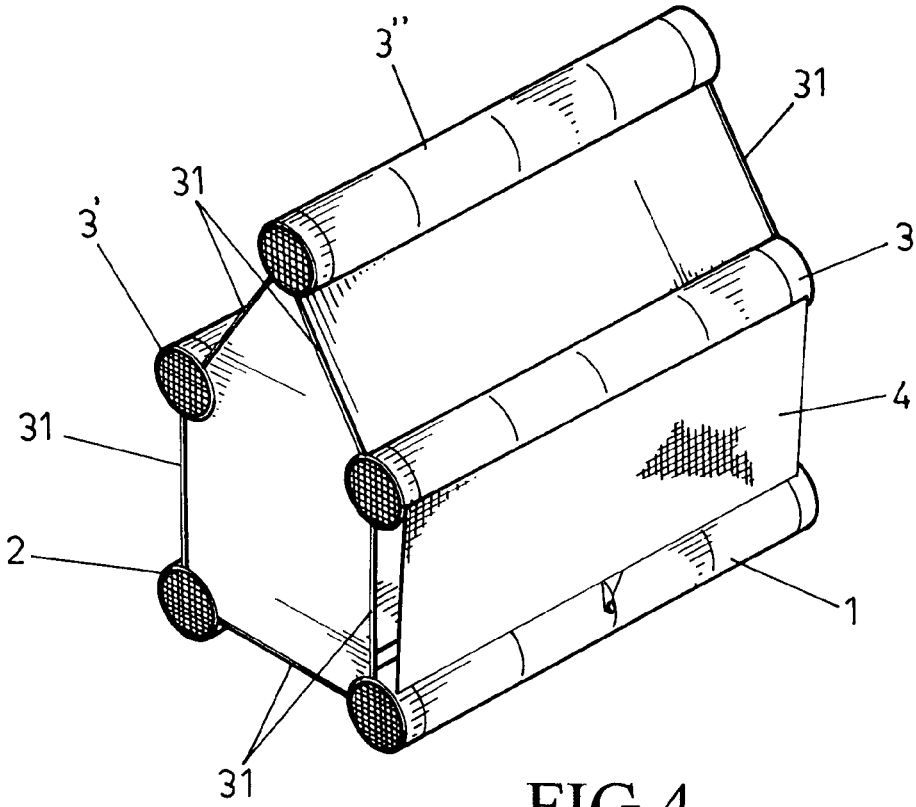
FIG. 4 shows a view of another embodiment according to the invention.

Referring to FIG. 3, a rectangular amphibious tent is formed with four inflated floats 1, 2, 3 and 3' connecting supporting frames 31. Referring to FIG. 4, a pentagonal amphibious tent is formed with five inflated floats 1, 2, 3, 3' and 3" connecting supporting frames 3 1.

Conclusive from the aforesaid descriptions, the amphibious tent capable of floating on water according to the invention comprising three or at least three floats made of plastic materials, not only provides accommodation effects on water but also serves as a lifeboat when sailed on a water surface.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An amphibious tent capable of floating on water comprising:

at least two bottom floats and at least one top float, each with a first end and a second end;

a first and second support frames connecting the first ends and the second ends of the floats respectively;

a first and second end bearing supported by connecting rods, interior of each support frame respectively;

screens that are furled in the top float, and are stretched and hooked to the bottom floats; and a base hanging between the two bottom floats, suspended from the end bearings; thereby forming a tent capable of floating on water.

2. The amphibious tent in accordance with claim 1, wherein the screens are erected to become a sail of a lifeboat.

* * * * *